US005079486A

United States Patent [19]

Honda et al.

[11] Patent Number: 5,079,486

[45] Date of Patent: Jan. 7, 1992

[54] DEFLECTION YOKE FOR COLOR CRT

[75] Inventors: Masanobu Honda; Toshio Kuramoto, both of Takatsuki City, Japan

[73] Assignee: Matsushita Electronics Corporation, Kadoma, Japan

[21] Appl. No.: 581,204

[22] Filed: Aug. 31, 1990

Related U.S. Application Data

[63] Continuation of Ser. No. 249,056, Sep. 23, 1988, abandoned.

[30] Foreign Application Priority Data

Mar. 2, 1988 [JP] Japan ..... 63-48923

[51] Int. Cl.[5] ..... G09G 1/04; H01J 29/56; H01F 7/00

[52] U.S. Cl. ..... 315/371; 335/210; 315/399

[58] Field of Search ..... 315/370, 371, 399; 335/210, 213

[56] References Cited

U.S. PATENT DOCUMENTS 4,704,564 11/1987 Ito et al. ..... 315/368
4,818,919 4/1989 Koboyashi et al. ..... 315/371

FOREIGN PATENT DOCUMENTS 2164055 7/1972 Fed. Rep. of Germany ..... 315/370
2526692 11/1975 Fed. Rep. of Germany ..... 315/370
5821772 2/1976 Japan .
58-21772 5/1983 Japan .
131645 10/1983 Japan .

*Primary Examiner*—Gregory C. Issing
*Attorney, Agent, or Firm*—Cushman, Darby & Cushman

[57] ABSTRACT

The constitutional body of the deflection yoke of the present invention comprises a vertical deflection coil which are constituted with two sets of coils two pairs of one for generating a pincushion magnetic field and one for generating a barrel magnetic field, and by connecting, to one set thereof, one set of diodes connected with each other, with the respective polarities of the diodes being opposite to each other, in parallel, the occurrence of inverse trilemma is substantially prevented.

4 Claims, 9 Drawing Sheets

DEFLECTION YOKE FOR COLOR CRT

This is a continuation of application Ser. No. 07/249,056, filed on Sept. 23, 1988, which was abandoned upon the filing hereof.

BACKGROUND OF THE INVENTION

1. Field of the Invention

The present invention relates to a deflection yoke device to be installed to a color CRT provided with an in-line type electron gun.

2. Description of the Related Art

When blue and red lines are displayed on the screen of a color CRT having an in-line type electron gun, misconvergence of a type as shown in FIG. 7 occurs. That is, in an intermediate region I occupying about one half of the effective size of the screen face in the vertical direction, lateral line misconvergence (positive trilemma) occurs such that blue lines 1B and 3B, which are in the first and the third quadrant, deviate obliquely toward the upper side from red lines 1R and 3R, respectively, while blue lines 2B and 4B, in the second and fourth quadrants, deviate obliquely toward the lower side from red lines 2R and 4R, respectively. And, in the upper and the lower regions II, lateral line misconvergence (negative trilemma) occurs such that blue lines 5B and 7B, in the first and the third quadrant, deviate obliquely toward the lower side from red lines 5R and 7R, respectively, while blue lines 6B and 8B, in the second and fourth quadrants, deviate obliquely toward the upper side from red lines 8R and 8R, respectively. In the prior art, it was not possible to solve the positive and negative trilemma problems at the same time. Throughout the specification and claims, the state under which the positive and negative trilemma occur is referred to as inverse trilemma.

As for the means through which the inverse trilemma is reduced, it has been proposed that, as shown in FIG. 8, at least in a part of either one of the horizontal deflection coils 9 and vertical deflection coils 10, that is, at angle regions 11 respectively slanting by about 35° from the horizontal axis x, vacant parts having no winding are provided (Japan Patent Kokoku No. Sho 58-21772). Hereupon, in FIG. 8, "B" indicates an insulating frame, and "C" indicates a core.

By the constitution as described above, for the first quadrant of the screen as shown in FIG. 9, it is possible to generate diagonal direction magnetic field distributions $12H_B$, $12H_R$, $13H_B$ and $13H_R$ that are able to establish a relation: $(13_B-13F_R)>>(12F_B-12F_R)(>0)$, where $(12F_B-12F_R)$ $(>0)$ is the difference between a Lorentz force $12F_B$ acting on a blue-light-emitting electron beam 12B and a Lorentz force $12F_R$ acting on a red-light-emitting electron beam 12R in the region I and $(13F_B-13F_R)$, $(>0)$ is the difference between a Lorentz force $13F_B$ acting on a blue-light-emitting electron beam 13B and a Lorentz force $13F_R$, acting on a red-light-emitting electron beam 13R in the regions II.

In such a manner, as shown in FIG. 10, it becomes possible that while making the amount of the negative trilemma $T_{11}$ $(<0)$ in the regions II as small as possible and thus reducing a difference $(T_1-T_{11})$ with respect to the amount of the positive trilemma, $T_1$ $(>0)$, in the region I, by increasing or decreasing the amount of protrusion of the vertical deflection magnetic field toward the electron gun side, the positive and negative trilemma can be reduced to their minima.

The reduction means for reducing the inverse trilemma as stated above, however, only adjusts the magnetic field distribution compromisingly. The reduction means is not able to remove the inverse trilemma completely.

By giving a vertical deflection magnetic field, having a strong barrel distortion to the optimum magnetic field distribution which does not produce pincushion type vertical isotropic astigmatic aberrations 14B, 14R, as shown in FIG. 11, nor barrel type vertical isotropic astigmatic aberrations 15B, 15R, as shown in FIG. 12, on the vertical axis y, a Lorentz force $16F_R$ in the +y direction acting on a red light emitting electron beam 16R can be made stronger relative to a Lorentz force $16F_B$ in the +y direction acting on a blue-light-emitting electron beam 16B. And, a Lorentz force $17F_B$ in the +y direction acting on a blue light emitting electron beam 17B can be made stronger relative to a Lorentz force $17F_R$ in the +y direction acting on a red light emitting electron beam 17R. Consequently, the positive trilemma occurring in the upper half part in the screen face intermediate region I can be removed.

Next, considering the period while the electron beam is scanning the upper region II of the screen face, if vertical deflection magnetic field distribution has a weaker barrel distortion in comparison with the optimum distribution, it is equivalent relative to the one in which a pincushion distortion is strengthened, and hence it can be explained using a model of a pincushion magnetic field shown in FIG. 14. As is obvious from this figure, a Lorentz force $18F_B$ in the +y direction acting on a blue-light-emitting electron beam 18B becomes relatively stronger than a Lorentz force $18F_R$ in the +y direction acting on a red-light-emitting electron beam 18R, whereas a Lorentz force $19F_R$ in the +y direction acting on a red-light-emitting electron beam 19R becomes relatively stronger than a Lorentz force 19FB in the +y direction acting on a blue-light-emitting electron beam 19B. This fact means that the negative trilemma 5B, 5R, 6B, and 6R, mentioned above, occurring in the upper region II of the screen face can be corrected.

When the electron beam is scanning the lower half part of the screen face also, because of the same reason as that described above, positive trilemma 3B, 3R, 4B, 4R and negative trilemma 7B, 7R, 8B, 8R can be corrected.

In case the electron beam scans the region I and the region II of the screen face, however, on the vertical deflection magnetic field, when the degree of its barrel distortion changes stronger and weaker respectively, as has been described from the above-mentioned optimum distribution, vertical isotropic astigmatic aberrations 20B, 20R, 21B, and 21R of shapes as shown in FIG. 15 occur on the vertical axis y. However, since those vertical isotropic astigmatic aberrations 20B and 20R occurring in the screen face region I are minute, they do not problematically affect the convergence quality. On the other hand, as for those pincushion type vertical isotropic astigmatic aberrations 21B and 21R occurring in the regions II, it is necessary to correct them in a particular way, and such correction can be achieved in a means described below. That is, while the electron beam is scanning the screen face regions II, by generating a quadrupole magnetic field 22, 23, 24, and 25, as shown in FIG. 16, which is synchronized to the vertical deflection period in the vicinity of the opening part on the electron gun side of a deflection yoke, the magnetic field 22 gives a Lorentz force $26F_B$ to an electron beam 26B in the −x direction, and the magnetic field 23 gives a Lorentz force $27F_R$ to an electron beam 27R in the +x direction, and thereby a pincushion type vertical isotropic astigmatic aberrations 21B and 21R in the screen face regions II of FIG. 15 can be corrected.

SUMMARY OF THE INVENTION

The present invention has been done based on the consideration as described above, and in accordance with the present invention, the vertical deflection coil is wound by dividing it into at least two sets of two pairs of pincushion magnetic field generating coil parts and barrel magnetic field generating coil parts. Then, to one set of those coils, two diodes, connected in parallel with each other with the respective polarities of the two diodes being opposite to each other, are connected in series.

By using two diodes connected in parallel with each other with the respective polarities of the two diodes being opposite to each other, the degree of barrel distortion may be switched in response to the beam deflection angle.

28 . . . vertical inner saddle coil, 29 . . . vertical outer saddle coil, 31 . . . toroidal coil, 32, 33 . . . diodes, 35 . . . vertical coma aberration correction coil, 39 . . . vertical isotropic astigmatic aberration correction coil.

DESCRIPTION OF THE PRESENTLY PREFERRED EMBODIMENTS

Figure 1:
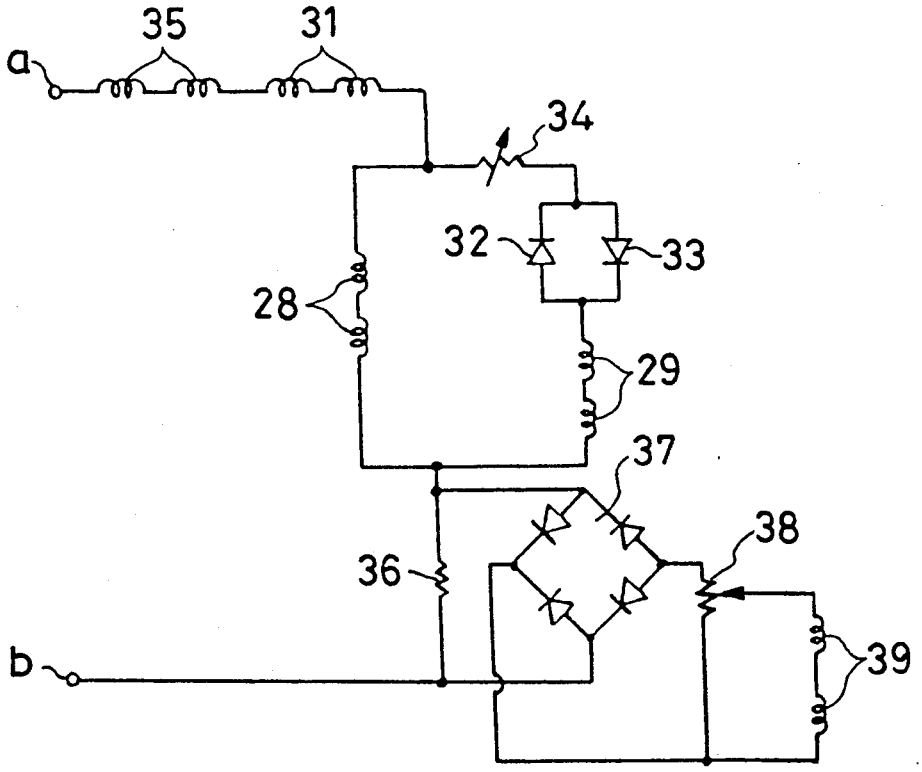
FIG. 1 is a wiring diagram of a vertical deflection coil of a deflection yoke device on which the present invention is embodied.
Figure 2:
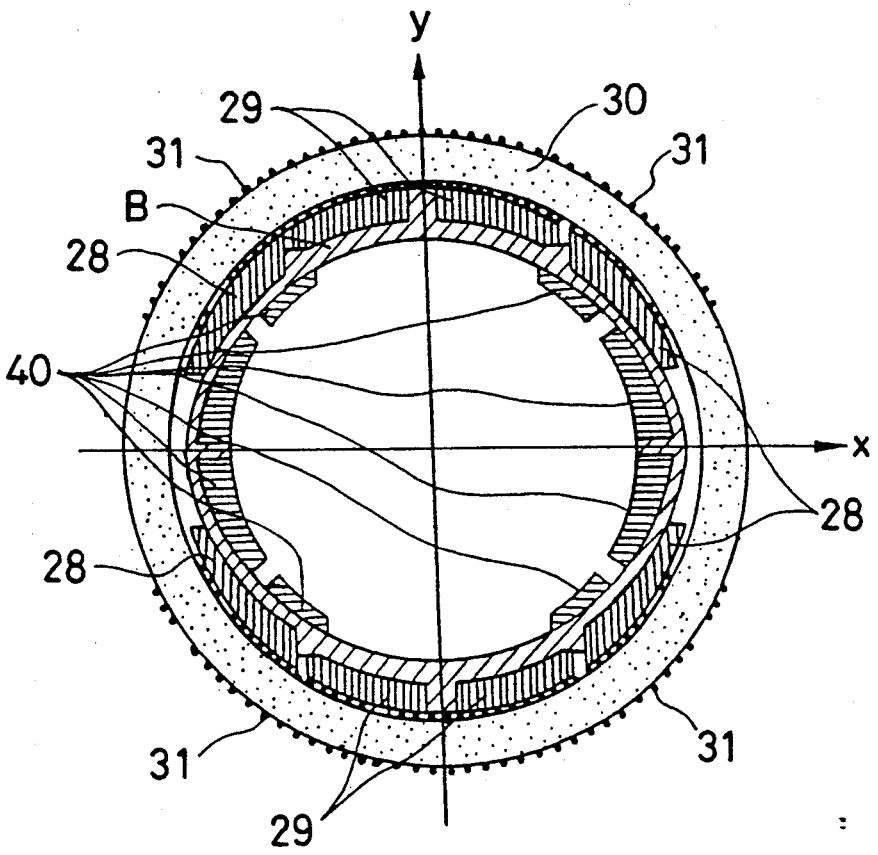
FIG. 2 is a lateral cross-sectional drawing of a deflection yoke of the above device.

The explanation of a working example using saddle-saddle-toroidal type deflection yoke (hereinafter called as SST deflection yoke) in which horizontal deflection coils are comprised of saddle type coils, and vertical deflection coils are comprised of saddle type coil parts and toroidal type coil parts, follows:

FIG. 1 shows the wiring of vertical deflection coils of the SST deflection yoke, wherein a pair of vertical inner saddle coil parts 28, 28 of the vertical deflection coils is wound at an angle between about 21° to 50°, measured from the horizontal axis x, as shown in FIG. 2, and generates a barrel magnetic field. A pair of vertical outer saddle coil parts 29, 29 is wound in an angle range of about 59° to 83°, measured from the horizontal axis x, as shown in FIG. 2, and generates a pincushion magnetic field. And, a pair of vertical toroidal coil parts 31, 31, wound uniformly on a high permeability ferrite core 30, is positioned in an angle range of about 25° to 90° measured from the horizontal axis x, and generates a barrel magnetic field. In FIG. 2, numeral 40 indicates a saddle type horizontal deflection coil, and B indicates an insulating bobbin.

Figure 3:
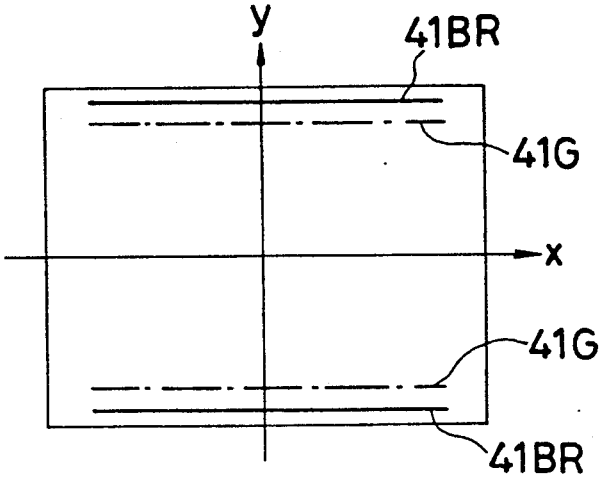
FIG. 3 is an explanatory drawing of the vertical coma aberration.

On the other hand, vertical coma aberration correction coils 35, 35, which are provided in the vicinity of the opening part on the electron gun side of the deflection yoke in order to correct the vertical coma aberration (lateral line misconvergence) shown in FIG. 3 as green lines 41G placed interior to blue/red lines 41BR in the vertical axis y direction, generate strong pincushion magnetic fields.

As is shown in FIG. 1, the vertical inner saddle coils 28, 28 are connected in parallel with a series connection comprising two diodes 32 and 33 connected to each other in parallel and at opposite polarity and the vertical outer saddle coils 29, 29 connected to each other in series. Between the high potential side of the vertical inner saddle coils 28, 28 and a terminal "a", a pair of vertical toroidal coils 31, 31 and a pair of vertical coma aberration correction coils 35, 35 are connected in series. Between the low potential side of the vertical inner saddle coils 28, 28 and a terminal "b", a resistor 36 is connected in series. On the load side of a full-wave rectification circuit 37, which is connected to the resistor 38 in parallel, the vertical isotropic astigmatic aberration correction coils 39, 39, which generate a quadrupole magnetic field thereby to correct the vertical isotropic astigmatic aberration, are connected. Furthermore, to the diodes 32, 33, a variable resistor 34 is connected. The variable resistor 34 adjusts the branching ratio of the vertical deflection current flowing through the vertical inner saddle coils 28, 28 and the vertical outer saddle coils 29, 29. In parallel with the vertical isotropic astigmatic aberration correction coils 39, 39, a variable resistor 38 for adjusting the amount of the correction of the vertical isotropic astigmatic aberration is connected.

By wiring respective coils comprising the vertical deflection coil as described above, the inverse trilemma as shown in FIG. 7 can be corrected, and the operation thereof is explained next.

Figure 4:
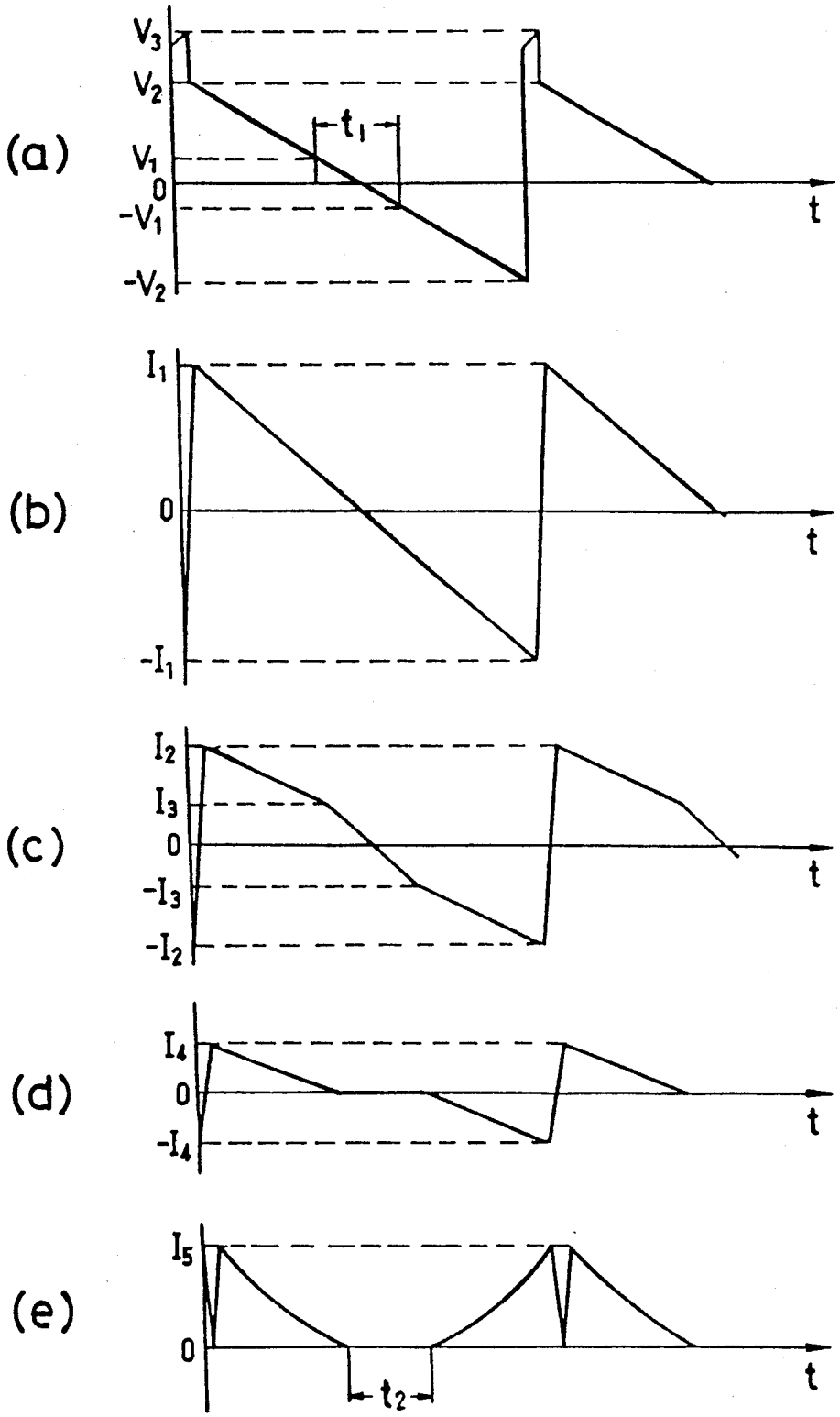
FIGS. 4 *a–e* are voltage and current waveforms at various parts of the circuit shown in FIG. 1.

When a vertical deflection voltage of a waveform as shown in (a) of FIG. 4 and of, for example, 60 Hz is applied across the high potential side terminal "a" and the low potential side terminal "b" a vertical deflection current of a waveform of 60 Hz, as shown in FIG. 4(*b*), flows through the aberration correction coils 35, 35 and the toroidal coils 31, 31. Since the diodes 32 and 33 are kept off until the vertical deflection voltage of (a) of FIG. 4 becomes $V_1$, the vertical outer saddle coils 29, 29 that generate pincushion magnetic fields do not work and only the vertical inner saddle coils 28, 28 that generate barrel magnetic fields work. Thus, the barrel distortion of the vertical deflection magnetic field is enhanced. Then, when the vertical deflection voltage of (a) of FIG. 4 exceeds $V_1$, the diodes 32 and 33 are turned to the on-state, the vertical outer saddle coils 29, 29 start working, and the barrel distortion of the vertical deflection magnetic field is weakened (in a relative sense, the pincushion distortion is strengthened). At this time, the waveforms of currents flowing through the vertical outer saddle coils 28, 28 and through the vertical outer saddle coils 29, 29 become nonlinear, respectively, as shown in (c) and (d) of FIGS. 4.

Figure 7:
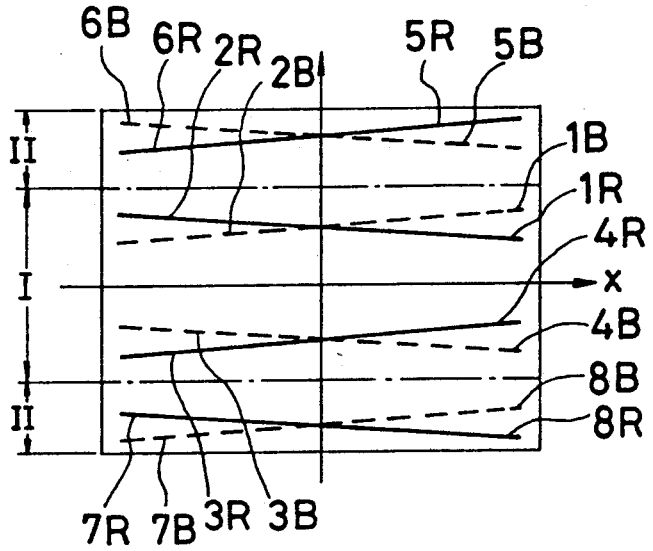
FIG. 7 is an explanatory drawing of the inverse trilemma.

As above, since the barrel distortion of the vertical deflection magnetic field can be strengthened in the off-period $t_1$ of the diodes 32 and 33 and the barrel distortion of the vertical deflection magnetic field can be weakened in the on-period, by taking a synchronism between the off-period $t_1$ of the diodes 32, 33 and the period of electron beam scanning over the screen face region I, it becomes possible to effectively remove those inverse trilemma of shapes as shown in FIG. 7.

In a working example using an SST deflection yoke for use with a 20 inch and 90° deflection in-line type color CRT, by setting those voltages $V_1$, $V_2$, $V_3$ on the vertical deflection voltage waveform of (a) of FIG. 4 to be 2.8 V, 11.5 V, and 17.5 V, setting respective currents $I_1$, $I_2$, $I_3$ and $I_4$ of vertical deflection current waveform, vertical inner saddle coils and the vertical outer saddle coils shown in FIGS. 4 (*b*), (*c*) and (*d*) to be 0.9 A, 0.6 A, 0.22 A, and 0.3 A, respectively, setting the off-period $t_1$ of the diodes 32 and 33 to be 4 msec, and setting the ampere-turns of the vertical coma aberration correction coils 35, 35, the toroidal coils 31, 31, the vertical inner saddle coils 28, 28, and the vertical outer saddle coils 29, 29 to be 180 $A_{pp}T$, 116 $A_{pp}T$, 44 $A_{pp}T$, and 10 $A_{pp}T$, respectively, the inverse trilemma of shapes, as shown in FIG. 7, could be almost eliminated.

Figure 16:
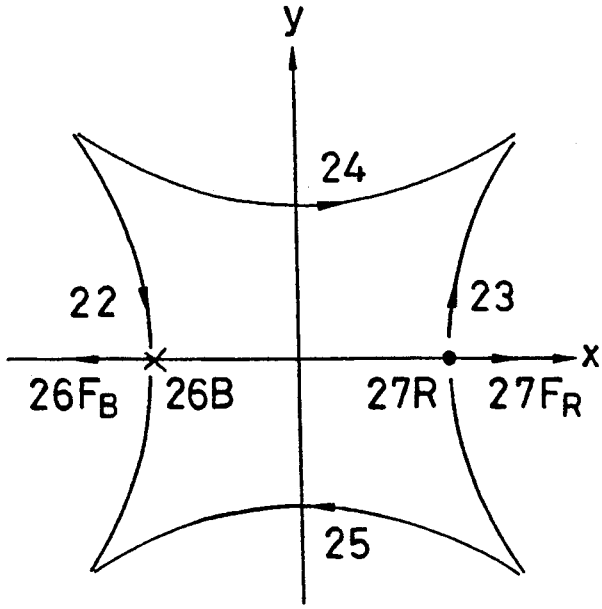
FIG. 16 is an explanatory drawing illustrating a quadrupole magnetic field for correcting the pincushion type vertical isotropic astigmatic aberration.

And, when the diodes 32 and 33 are turned to the on-state, the vertical outer saddle coils 29, 29 start working, and thereby the barrel distortions of the vertical deflection magnetic field are weakened, and then, pincushion type vertical isotropic astigmatic aberrations 21B and 21R appear on the y axis of the screen face regions II. This can be corrected because of the capability of generation of a quadrupole magnetic field as shown in FIG. 16, by feeding a parabolic-wave current as shown by (e) of FIG. 4, from the full wave rectifier 37 actuated by a voltage appearing across the ends of the resistor 36 to the vertical isotropic astigmatic aberration correction coils 39, 39.

In the present working example, by setting the current $I_5$ flowing through the vertical isotropic astigmatic aberration correction coil to be 0.06 A, the off-period ($t_2$ of FIG. 4 (*e*)) of diodes constituting the full-wave rectification circuit 37 to be 4 msec, and the ampere-turn of the vertical isotropic astigmatic aberration correction coil to be 4 $A_{pp}T$, it is possible to correct the pincushion type vertical isotropic astigmatic aberration of about 0.5 mm occurring on the vertical axis y of the screen face regions II. Hereupon, by making the off-period of diodes constituting the fullwave rectification circuit 37 synchronize to the offperiod of diodes 32 and 33, the pincushion type vertical isotropic astigmatic aberration occurring on the vertical axis y of the screen face regions II can be corrected in good order.

The barrel type vertical isotropic aberration appearing on the y axis in the screen face region I is only within 0.05 mm, hence it is not problematic on the convergence quality.

Hereupon, in the working example described above, although the SST deflection yoke for use with 20-inch 90° deflection in-line type CRT was used, it is not limited to this embodiment. A saddle-saddle type deflection yoke (SS deflection yoke) wherein both the horizontal deflection coil and the vertical deflection coil are either composed of saddle coils or a saddle-toroidal type deflection yoke (ST deflection yoke) wherein the horizontal deflection coil is composed of saddle coils and the vertical deflection coil is composed of toroidal coils can also be applied.

Figure 5:
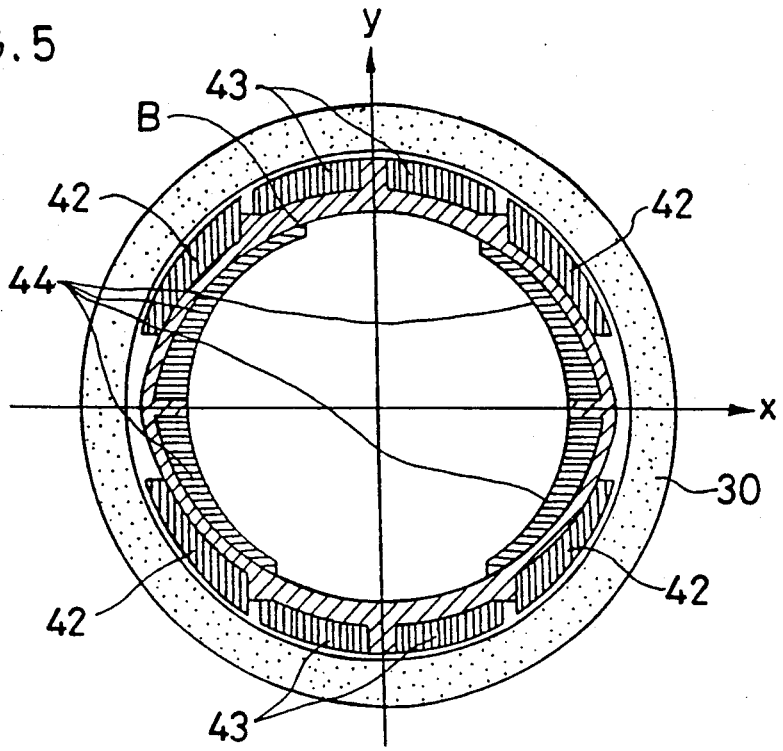
FIG. 5 is a lateral cross-sectional drawing of the deflection yoke of a working example to which an SS deflection yoke is applied.
Figure 6:
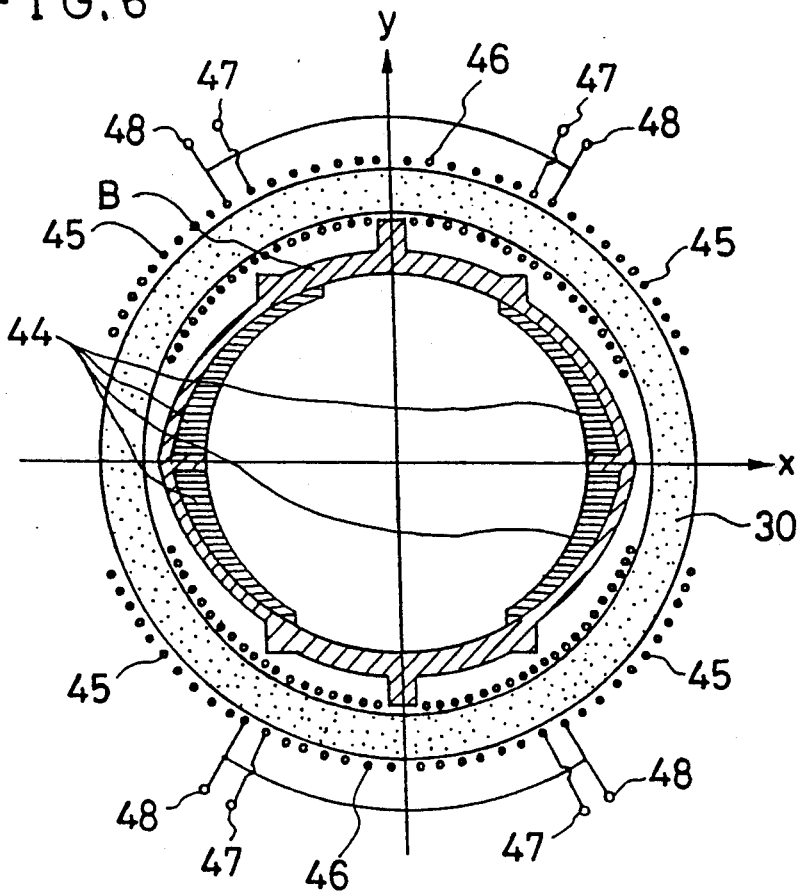
FIG. 6 is a lateral cross-sectional drawing of the deflection yoke of a working example to which an ST deflection yoke is applied.
Figure 8:
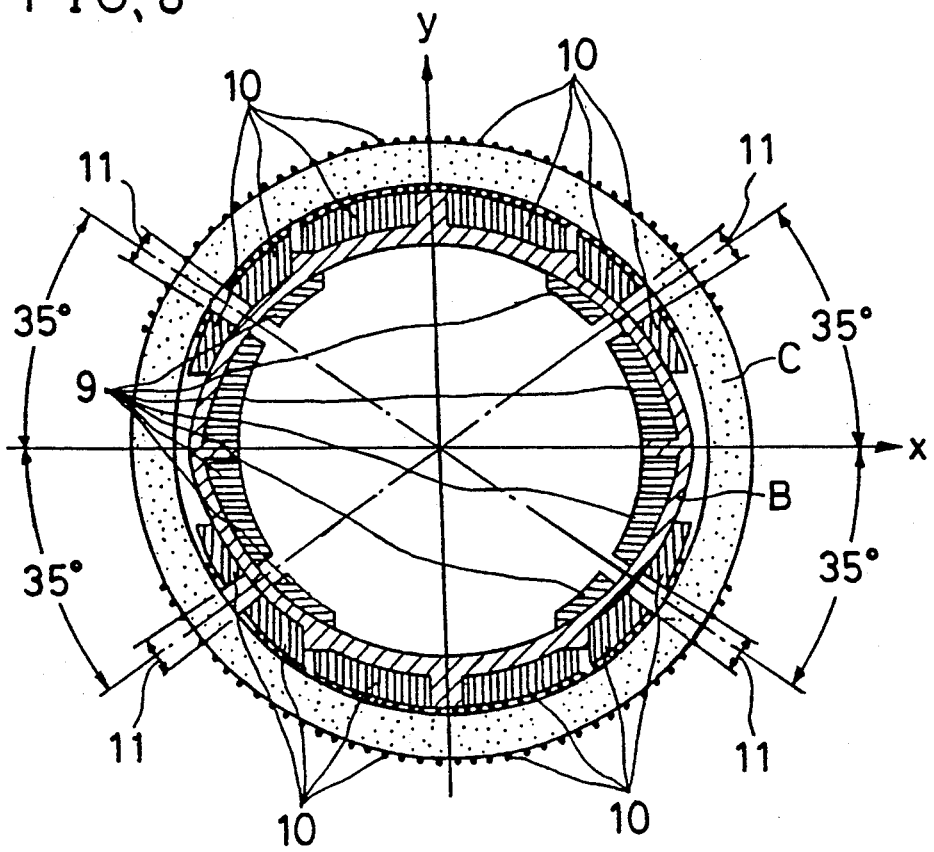
FIG. 8 is a lateral cross-sectional drawing of the deflection yoke showing a blank part of the deflection yoke.
Figure 9:
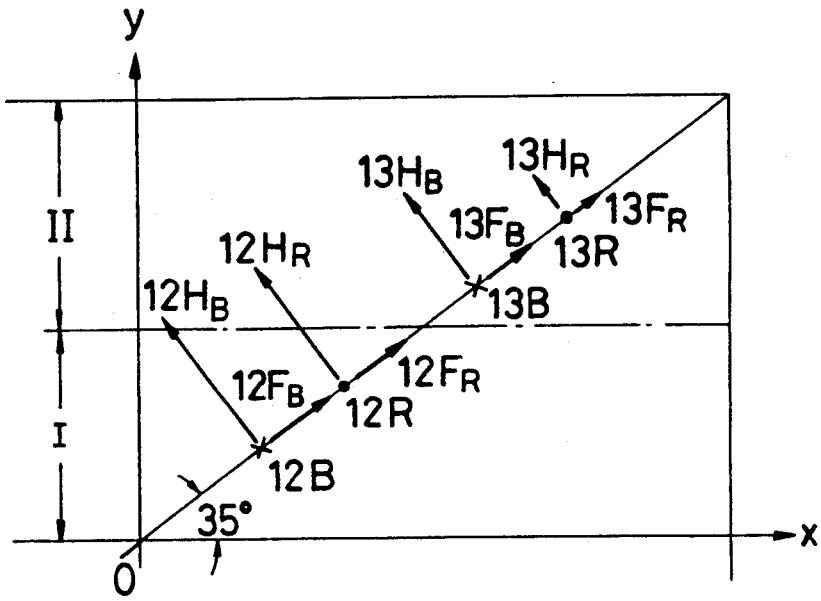
FIG. 9 is an explanatory drawing showing conventional means for reducing the inverse trilemma.
Figure 10:
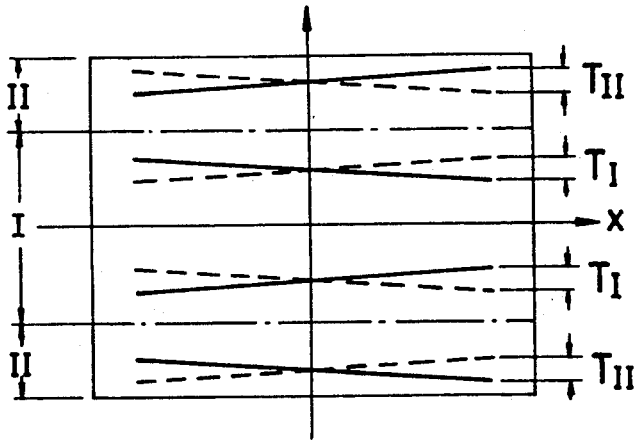
FIG. 10 is an explanatory drawing showing a degree of trilemma.
Figure 11:
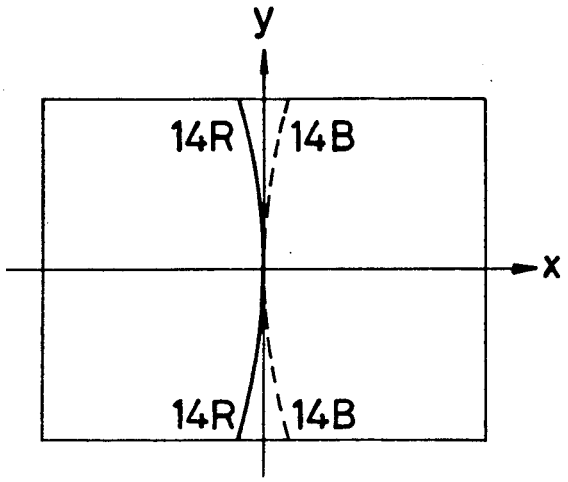
FIGS. 11 and 12 are explanatory drawings illustrating the vertical isotropic astigmatic aberration distribution.
Figure 12:
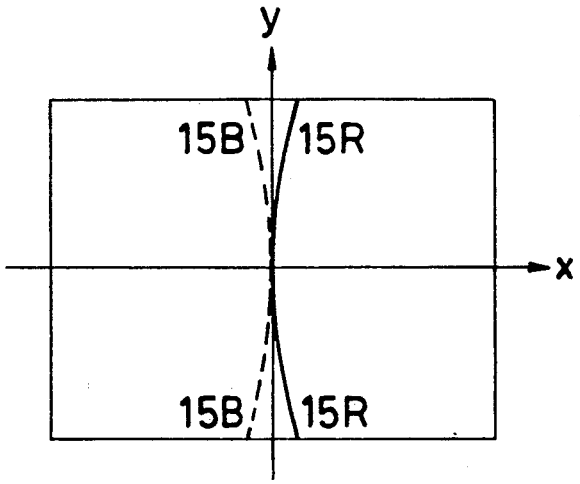
Figure 13:
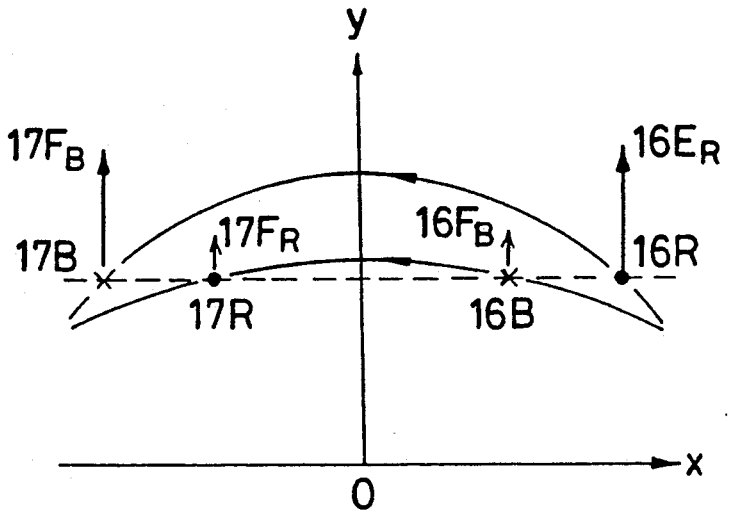
FIGS. 13 and 14 are explanatory drawings illustrating the principle of a removing means of the inverse trilemma.
Figure 14:
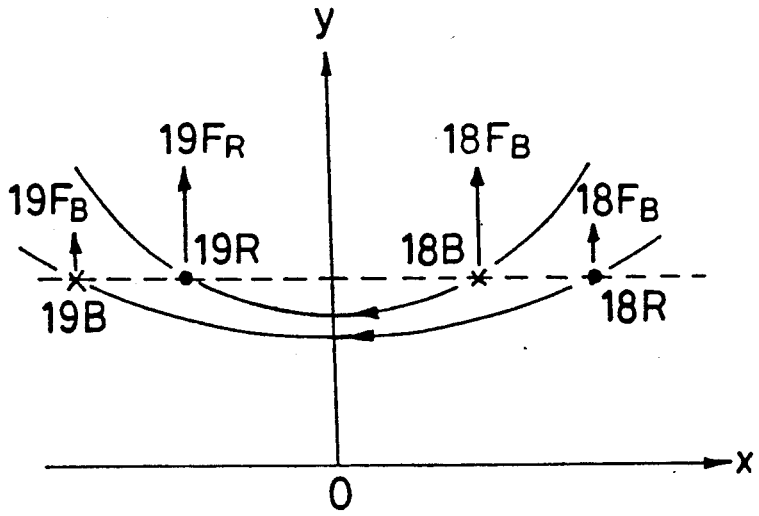
Figure 15:
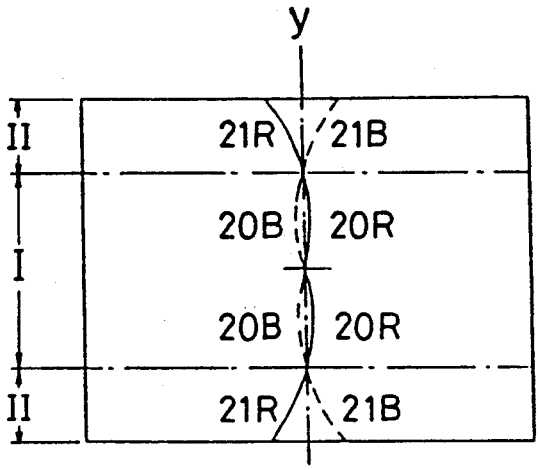
FIG. 15 is an explanatory drawing illustrating the vertical isotropic astigmatic aberration.

In the SS deflection yoke coil, as is shown in FIG. 5, it can be constituted in a manner that the vertical deflection coil is wound, dividing it into at least two pairs of two sets of coils 42 which are wound in an angle range of about 0° to 60° measured from the horizontal axis x, to generate barrel magnetic fields; and coils 43, which are wound in an angle range of about 60° to 90°, to generate pincushion magnetic fields. Then to one set of the coils, at least two diodes, which are connected in parallel with each other with the respective polarities of the two diodes being opposite to each other, are connected in series. And in the ST deflection yoke, as shown in FIG. 8, it is constituted in a manner that intermediate taps 47 and 48 are taken out from the toroidal coils, and these coils are wound by dividing them into at least two pairs of two sets of coil parts 45 which are wound in an angle range of about 0° to 60°, measured from the horizontal axis x, and generate barrel magnetic fields. Coil parts 46, which are wound in an angle range of about 60° to 90°, generate pin-cushion magnetic fields. Then, to one set of coils, two diodes, which are connected in parallel with each other with the respective polarities of the two diodes being opposite to each other, are connected in series.

As has been described above, in accordance with the present invention, depending on the period while the electron beam is scanning the screen face intermediate range I and the period while the electron beam is scanning the remaining regions II, respective distortion factors of their vertical deflection magnetic field distributions can be changed separately, and thus it becomes possible to correct all possible shapes and amounts of trilemma occurring in region I and regions II. In a deflection yoke which is designed in a manner that its horizontal deflection magnetic field distribution does not produce either pincushion type or barrel type distortions on the top edge and on the bottom edge of the screen face when a rectangular raster is displayed on the screen face, the case where negative or positive trilemma occurs in the screen face regions II and a means for minimizing those trilemma is available for increasing or decreasing the amount of divergence of the vertical deflection magnetic field toward the electron gun side, there exists a disadvantage that the barrel type or pincushion type distortions occur on the top edge and the bottom edge of the raster; but in the present invention, since it employs a scheme that the trilemma in the screen face regions II are removed by the varying distortion factor of the vertical deflection magnetic field, there is an advantage that distortions appearing on the top edge and the bottom edge are minimal.

What is claimed is:

1. A deflection yoke device, comprising:

a deflection yoke to be installed on a neck part of color CRT having an in-line type electron gun, said deflection yoke having a pair of horizontal deflection coils, a pair of toroidal type vertical deflection coils, which generate a barrel magnetic field, two pairs of saddle type vertical deflection coils, one pair of which generate a barrel magnetic field and the other pair of which generate a pincushion magnetic field, said one pair of saddle type vertical deflection coils being connected in series with said toroidal type vertical deflection coils, and a pair of vertical coma aberration correction coils; and a diode circuit which is connected in series to said other pair of saddle type vertical deflection coils to form a branching circuit in parallel with said one pair of saddle type vertical deflection coils, said diode circuit comprising two diodes having respective polarities, the diodes connected in parallel with each other with the respective polarities being opposite to each other, wherein said deflection yoke is characterized by a vertical deflection voltage, said diode circuit being kept off to inhibit the generation of the pincushion magnetic field until the vertical deflection voltage reaches a predetermined value.

2. A deflection yoke device, comprising:

a deflection yoke to be installed on a neck part of a color CRT having an in-line type electron gun, said deflection yoke having a pair of horizontal deflection coils and at least two pairs of saddle type vertical deflection coils wherein one pair of said vertical deflection coils generate a barrel magnetic field and the other pair of said vertical deflection coils generate a pincushion magnetic field, and a pair of vertical coma aberration correction coils; and a diode circuit which is connected in series to said other pair of saddle type vertical deflection coils to form a branching circuit in parallel with said one pair of saddle type vertical deflection coils, said diode circuit comprising two diodes having respective polarities, the diodes connected in parallel with each other with the respective polarities being opposite to each other, wherein said deflection yoke is characterized by a vertical deflection voltage, said diode circuit being kept off to inhibit the generation of the pincushion magnetic field until the vertical deflection voltage reaches a predetermined value.

3. A deflection yoke device, comprising:

a deflection yoke to be installed on a neck part of a color CRT having an in-line type electron gun, said deflection yoke having a pair of horizontal deflection coils and at least two paris of toroidal type vertical deflection coils wherein one pair of said vertical deflection coils generate a barrel magnetic field and the other pair of said vertical deflection coils generate a pincushion magnetic field, and a pair of vertical coma aberration correction coils; and a diode circuit which is connected in series to said other pair of toroidal type vertical deflection coils to form a branching circuit in parallel with said one pair of toroidal type vertical deflection coils, said diode circuit comprising two diodes having respective polarities, the diodes connected in parallel with each other with the respective polarities being opposite to each other, wherein said deflection yoke is characterized by a vertical deflection voltage, said diode circuit being kept off to inhibit the generation of the pincushion magnetic field until the vertical deflection voltage reaches a predetermined value.

4. A deflection yoke device in accordance with claim 1, 2 or 3, wherein said branching circuit further includes a variable resistor.

* * * * *